US006747198B1

(12) United States Patent
Sullivan

(10) Patent No.: US 6,747,198 B1
(45) Date of Patent: Jun. 8, 2004

(54) REED AND MOUTHPIECE ASSEMBLY

(76) Inventor: George V. Sullivan, 71 Hopmeadow St. Condo #7A1, Weatoque, CT (US) 06089

( * ) Notice: Subject to any disclaimer, the term of this patent is extended or adjusted under 35 U.S.C. 154(b) by 0 days.

(21) Appl. No.: 10/318,274

(22) Filed: Dec. 12, 2002

Related U.S. Application Data

(63) Continuation-in-part of application No. 09/884,192, filed on Jun. 19, 2001, now Pat. No. 6,501,010.

(60) Provisional application No. 60/371,208, filed on Apr. 9, 2002, and provisional application No. 60/217,203, filed on Jul. 10, 2000.

(51) Int. Cl.[7] ..... G10D 9/02

(52) U.S. Cl. ..... 84/383 R; 84/383 A

(58) Field of Search ..... 84/383 A, 380 R, 84/383 R

(56) References Cited

U.S. PATENT DOCUMENTS 4,745,838 A * 5/1988 Johnson ..... 84/383 R
4,941,385 A * 7/1990 Johnson ..... 84/383 R
5,018,425 A * 5/1991 Rovner ..... 84/383 R
5,303,628 A * 4/1994 Salazar ..... 84/383 R

* cited by examiner

*Primary Examiner*—Kimberly Lockett
(74) *Attorney, Agent, or Firm*—Sperry, Zoda & Kane

(57) ABSTRACT

The present invention provides a unique configuration for a reed and mouthpiece assembly for a woodwind instrument, such as a clarinet or saxophone, wherein the reed is formed with a special configuration having a mating shape defined therein which is engageable with respect to a protruding member or members extending outwardly from the generally planar reed mounting surface of the woodwind mouthpiece. A slot or other aperture can be defined in the non-vibrating clamped portion of the reed in order to facilitate alignment thereof during mounting with respect to a generally planar reed mounting area of the woodwind mouthpiece. A uniquely configured mouthpiece having a protruding member in combination with a uniquely shaped reed for engagement therewith provides a self-aligning and self-centering reed which is usable with any type of attachment mechanism including conventional or other ligatures as well as the unique securement device described herein. The engagement between the protruding member and the unique reed provides for faster and easier alignment during reed installation onto a woodwind mouthpiece despite what type of ligature is used. Preferably the protruding member or members are removable to facilitate use of the mouthpiece with a conventional reed configuration if desired.

32 Claims, 7 Drawing Sheets

REED AND MOUTHPIECE ASSEMBLY

This application is a continuation-in-part of and claims filing priority rights with respect to currently pending U.S. utility patent application Ser. No. 09/884,192, filed Jun. 19, 2001, now U.S. Pat. No. 6,501,010, on "Reed and Mouthpiece Assembly" which claims filing priority rights of provisional patent application No. 60/217,203, filed Jul. 10, 2000 entitled "Reed And Mouthpiece Assembly" both by the same applicant herein, namely, George V. Sullivan. The present application also claims filing priority rights of U.S. provisional patent application No. 60/371,208 filed Apr. 9, 2002, now pending, on "Improved Reed and Mouthpiece Assembly", by the same applicant as named herein, namely, George V. Sullivan.

BACKGROUND OF THE INVENTION

1. Field of the Invention

The present invention deals with the field of musical instruments and, in particular, woodwind instruments, such as clarinets and saxophones, which utilize a moistened reed during performance thereof. Such reeds often become unusable and need to be repeatedly changed, sometimes quickly, such as during an ongoing performance, which is often difficult to do under time constraints or with limited lighting or by individuals unaccustomed to such reed replacement.

The reed must be properly aligned longitudinally with respect to the mouthpiece in such a manner that proper tone is produced by the instrument for the particular musical application being played. The present invention provides a self-aligning and self-centering reed as well as a woodwind mouthpiece for use therewith. The configuration of the present invention, while describing a unique securement device, is usable with any type of ligature means, such as conventional or other types of ligatures, which function to detachably affix the reed with respect to the generally planar reed mounting surface of the woodwind mouthpiece while allowing selective replacement thereof as needed. Preferably the protruding portion of the mouthpiece of the present invention is removable therefrom to facilitate use thereof with a more standardly configured reed if desired.

2. Description of the Prior Art

Various configurations have been developed for reeds for musical instruments, usually woodwind instruments, and for the mouthpieces usable therewith such as shown in U.S. Pat. No. 147,202 patented Feb. 3, 1874 to C. W. Vogel on "Reed-Organs"; and U.S. Pat. No. 477,661 patented Jun. 28, 1892 to H. Janes on a "Vibrator For Reed Musical Instruments"; and U.S. Pat. No. 488,828 patented Dec. 27, 1892 to C. S. Mudge on a "Musical Instrument"; and U.S. Pat. No. 555,561 patented Mar. 3, 1896 to G. R. Cadwallader on a "Reed Supporter For Clarinets"; and U.S. Pat. No. 1,506,364 patented Aug. 26, 1924 to H. M, Chiron et al on a "Reed For Saxophone Or Clarinet Mouth Pieces"; and U.S. Pat. No. 1,535,537 patented Apr. 28, 1925 to W. Majeski an "Adjustable Reed In Wind Instruments"; and U.S. Pat. No. 1,615,549 patented Jan. 25, 1927 to B. Miller on a "Mouthpiece For Reed Instruments"; and U.S. Pat. No. 1,667,836 patented May 1, 1928 to F. Brockman, Jr. on a "Reed For Musical Wind Instruments"; and U.S. Pat. No. 1,776,566 patented Sep. 23, 1930 to H. B. Newton et al on a "Mouth Reed For Musical Instruments"; and U.S. Pat. No. 1,779,522 patented Oct. 28, 1930 to C. O. Widmayer on a "Reed For Clarinets And Saxophones"; and U.S. Pat. No. 2,106,016 patented Jan. 18, 1938 to H. T. Prescott on a "Reed For Musical Instruments"; and U.S. Des. Pat. No. Des. 112,783 patented Jan. 3, 1939 to O. C. Noble and assigned to Tygart Valley Glass Company on a "Jar"; and U.S. Des. Pat. No. Des. 119,602 patented Mar. 26, 1940 to A. A. Verville on a "Reed For A Musical Instrument"; and U.S. Pat. No. 2,268,641 patented Jan. 6, 1942 to A. Brilhart on a "Reed For Musical Instruments"; and U.S. Pat. No. 2,287,529 patented Jun. 23, 1942 to M. Maccaferri on a "Reed Of Cane, Plastic, Or Any Other Material For Clarinets, Saxophones, And Like Musical Instruments"; and U.S. Pat. No. 2,342,836 patented Feb. 29, 1944 to A. Brilhart and assigned to Arnold Brilhart Ltd. on a "Reed For Musical Instruments"; and U.S. Pat. No. 2,375,934 patented May 15, 1945 on a "Reed"; and U.S. Pat. No. 2,492,366 patented Dec. 27, 1949 to A. L. Ohnhaus on a "Wood-Wind Reed"; and U.S. Pat. No. 2,669,897 patented Feb. 23, 1954 to J. Topor on a "Reed For Musical Instruments"; and U.S. Pat. No. 3,183,760 patented May 18, 1965 to A. Michel on "Reeds For Application In Musical Instruments Particularly In Electronic Musical Instruments"; and U.S. Pat. No. 3,202,032 patented Aug. 24, 1965 to A. R. Strathmann on a "Mouthpiece For Saxophones And clarinets"; and U.S. Pat. No. 3,564,965 patented Feb. 23, 1971 to J. A. Carlini on a "Ligature For Reed Musical Instrument"; and U.S. Pat. No. 3,905,268 patented Sep. 16, 1975 to J. G. Gamble on "Reeds For Saxophones, Clarinets And Other Woodwinds"; and U.S. Pat. No. 4,056,997 patented Nov. 8, 1977 to P. L. Rovner on a "Reed Holding Device For Musical Instruments"; and U.S. Pat. No. 4,145,949 patented Mar. 27, 1979 to F. A. Kilian on a "Musical Reed"; and U.S. Pat. No. 4,172,482 patented Oct. 30, 1979 to H. M. Gomez on a "Method And Apparatus For Adjusting Single Reeds For Musical Instruments"; and U.S. Pat. No. 4,337,683 patented Jul. 6, 1982 to J. G. Backus on a "Synthetic Woodwind Instrument Reed And Method For Its Manufacture"; and U.S. Pat. No. 4,355,560 patented Oct. 26, 1982 to D. W. Shaffer on a "Reed Construction"; and U.S. Pat. No. 4,449,439 patented May 22, 1984 to F. E. Wells on a "Mouthpiece For Woodwind Instruments"; and U.S. Pat. No. 4,572,257 patented Feb. 25, 1986 to E. B. Laker on an "Apparatus For Profiling Reeds For Double-Reed Musical Instruments"; and U.S. Pat. No. 4,644,649 patented Feb. 24, 1987 to R. C. Seaman et al on an "Apparatus For Trimming Reeds Of Musical Instruments"; and U.S. Pat. No. 4,796,507 patented Jan. 10, 1989 to T. L. Stibal on a "Reed Holding Device"; and U.S. Pat. No. 4,941,385 patented Jul. 17, 1990 to C. O. Johnson on a "Tone Plate And Clamping Device For A Musical Instrument Mouthpiece"; and U.S. Pat. No. 4,991,483 patented Feb. 12, 1991 to R. Petit on a "Mouthpiece For Wind Instrument, And Corresponding Ligature And Mouthpiece Cover"; and U.S. Pat. No. 5.000,073 patented Mar. 19, 1991 to D. Hite on a "Construction For Supporting A Reed Upon The Mouthpiece Of A Musical Wind Instrument And Method Of Fabricating The Same"; and U.S. Pat. No. 5,018,425 patented to P. L. Rovner on May 28, 1991 on a "Mouthpiece System For Woodwind Instruments"; and U.S. Pat. No. 5,033,350 patented Jul. 23, 1991 to A. Galper on a "Single Reed Mouthpiece"; and U.S. Pat. No. 5,105,701 patented Apr. 21, 1992 to J. Hall et al on a Clarinet Mouthpiece"; and U.S. Pat. No. 289,752 patented Mar. 1, 1994 to E. Barbaglia on a "Device For Fastening The Reed On The Mouthpiece of Wind Instruments"; and U.S. Pat. No. 5,398,582 patented Mar. 21, 1995 to G. T. Smith and assigned to Mobile Music, Inc., Gary Smith and Joseph Stefano on a "Wire Clamping Ligature For Use With A Single Reed Mouthpiece For A Musical Instrument"; and U.S. Pat. No. 5,479,842 patented Jan. 2, 1996 to W. H. Ostermeyer on "Flavored Musical Instrument Reeds"; and U.S. Pat. No. 6,020,545 patented Feb. 1, 2000 to J. J.

Consoli on a "Ligature For The Mouthpiece of A Woodwind Musical Instrument".

SUMMARY OF THE INVENTION

The present invention provides a unique configuration for a reed for use with a uniquely configured woodwind mouthpiece assembly which when utilized together provide an improved means of attaching of a reed with respect thereto which is easy to align and replace. Also this configuration is particularly easy for those inexperienced in replacing such reeds such as young persons in their initial stages of learning how to play a woodwind musical instrument. The design makes use of a reed having a unique engaging configuration which can include a reed slot or notch or hole for alignment. The mouthpiece will define a protruding means or member for mated abutment with respect to the engaging configuration of the reed. The protruding member may comprise a pin, arm, spine plate or stud. Such protruding member is usually capable of being captured within the aperture, hole, notch or slot of the engaging means defined in the uniquely configured reed. Any of these protruding members are preferably removable from the mouthpiece to allow usage thereof with a standard reed if desired.

In particular, the present invention includes a specially designed reed and mouthpiece assembly used with various woodwind musical instruments such as saxophones or clarinets. In the preferred configuration of the present invention, the mouthpiece assembly will be capable of usage with a standard reed and standard ligature however it is better suited for use with the uniquely mated reed and securement configuration disclosed here which includes an engaging means for greatly facilitating alignment thereof with the reed mounting surface. The mouthpiece itself includes a mouthpiece body with an air conduit extending longitudinally therethrough for providing a supply of air to aid in the playing of the instrument. A reed placement surface is defined on the mouthpiece body adjacent the air conduit and is adapted to receive a reed detachably secured thereagainst. This reed placement surface is preferably oriented parallel with respect to the air conduit.

In a preferred embodiment, a reed is included which has a specially configured reed slot which extends therealong. The reed is adapted to be detachably secured to the reed placement surface adjacent the air conduit of a mouthpiece body to control air flow therethrough. The reed is preferably oriented extending parallel with respect to the air conduit. The reed slot also preferably is outwardly flared in the end portions thereof to facilitate movement to alignment with respect to a stud. The reed is also preferably beveled downwardly adjacent the reed slot to facilitate movement thereof beneath a pressure plate.

A self-aligning reed securement configuration is attached to the mouthpiece and is adapted to selectively retain the reed in proper alignment on the placement surface. This self-aligning reed securement configuration can include a stud which may be used for mounting and is secured to the reed placement surface and extending outwardly therefrom. The stud is adapted to extend through the reed slot to facilitate alignment thereof when the reed is positioned on the reed placement surface. The stud also preferably includes a thread means defined thereon. Preferably the stud is removable to allow usage with a standard reed and ligature if desired.

A tightening device is engageable with respect to the threads and is detachably secured to the stud to be movable therealong. The tightening device or ligature is adapted to exert a force selectively toward the reed for retaining it in engagement with respect to the placement surface in such a manner that the reed is positioned with the stud extending through the reed slot. The tightening device can include a knob preferably which is engageable with respect to the threads defined on the stud to aid in directing force toward the reed for retaining it in engagement with respect to the mouthpiece. This knob device is adjustably positionable with respect to the threads of the stud to allow adjustable control of the force directed onto the reed and to facilitate removal and replacement thereof. The knob preferably will include a knurled external surface extending therearound to further facilitate tightening and loosening thereof.

An alignment spine may be included extending upwardly from the reed placement surface in such a manner as to be positioned within the reed slot of the reed when it is located on the placement surface to enhance alignment between the reed and the mouthpiece. The alignment spine is preferably oriented extending parallel with respect to the reed slot and with respect to the air conduit whenever the reed is in engagement with the reed placement surface. The alignment spine can include a tab means extending further outwardly preferably in an upward direction therefrom for the alignment of a pressure plate.

A pressure plate may be included positioned between the tightening-knob and the reed to facilitate retaining the reed in position with respect to the mouthpiece. This pressure plate defines a pressure plate hole extending therethrough which is adapted to receive the stud thereinto to facilitate placement between the tightening knob and the reed. The pressure plate preferably defines a pressure plate notch in order to facilitate the tab of the alignment spine positioned therein in maintaining longitudinal alignment between the pressure plate and the alignment spine and the reed itself. This pressure plate preferably includes a first leg member which extends downwardly and longitudinally therealong as well as a second leg member which extends downwardly and longitudinally therealong at a position spatially disposed from the first leg member to define therebetween a reed retaining cavity within the pressure plate. This reed retaining cavity will facilitate holding of the reed in position properly aligned in abutment with respect to the reed placement surface. A protrusion means may be included extending downwardly from the pressure plate into the retaining cavity between the first leg member and the second leg member in order to abut the reed when positioned within the reed retaining cavity to facilitate holding thereof.

It is an object of the present invention to provide a unique configuration for a reed and mouthpiece assembly for woodwind instruments such as clarinets and saxophones which is self-aligning and is usable with any type of standard or uniquely designed ligature or securement device.

It is an object of the present invention to provide a unique configuration for a reed and mouthpiece assembly for a woodwind instrument which is self-aligning and usable with woodwind instruments such as clarinets and saxophones wherein faster installation of the reed is made possible.

It is an object of the present invention to provide a unique configuration for a reed and mouthpiece assembly wherein removal and properly aligned installation of a reed with respect to the reed placement surface of a mouthpiece is made easier.

It is an object of the present invention to provide a unique configuration for a reed and mouthpiece assembly for a woodwind instrument which is self-aligning and usable with woodwind instruments such as clarinets and saxophones wherein alignment is achieved both vertically and horizontally during placement of the reed.

It is an object of the present invention to provide a unique configuration for a reed and mouthpiece assembly for a woodwind instrument which is self-aligning and usable with any type of woodwind instruments such as clarinets and saxophones wherein the reed is placed more accurately.

It is an object of the present invention to provide a unique configuration for a reed and mouthpiece assembly for a woodwind instrument which is self-aligning and usable with woodwind instruments such as clarinets and saxophones wherein the additional cost of the equipment is minimal.

It is an object of the present invention to provide a unique configuration for a reed and mouthpiece assembly for a woodwind instrument which is self-aligning and usable with woodwind instruments such as clarinets and saxophones wherein there is a minimum number of moving parts.

It is an object of the present invention to provide a unique configuration for a reed and mouthpiece assembly for a woodwind instrument which is self-aligning and usable with woodwind instruments such as clarinets and saxophones wherein breakage is minimized.

It is an object of the present invention to provide a unique configuration for a reed and mouthpiece assembly for a woodwind instrument which is self-aligning and usable with woodwind instruments such as clarinets and saxophones wherein the possibility of installing the reed incorrectly is minimized.

It is an object of the present invention to provide a unique configuration for a reed and mouthpiece assembly for a woodwind instrument which is self-aligning and usable with woodwind instruments such as clarinets and saxophones wherein frustration which often occurs with new musicians is minimized.

It is an object of the present invention to provide a unique configuration for a reed and mouthpiece assembly for a woodwind instrument which is self-aligning and usable with woodwind instruments such as clarinets and saxophones wherein the reed and the ligature need not be handled at the same time.

It is an object of the present invention to provide a unique configuration for a reed and mouthpiece assembly for a woodwind instrument which is self-aligning and usable with woodwind instruments such as clarinets and saxophones wherein breaking of the reed while placing it in the ligature is no longer a problem.

It is an object of the present invention to provide a unique configuration for a reed and mouthpiece assembly for a woodwind instrument which is self-aligning and usable with woodwind instruments such as clarinets and saxophones wherein reed life is significantly extended.

It is an object of the present invention to provide a unique configuration for a reed and mouthpiece assembly for a woodwind instrument which is self-aligning and usable with woodwind instruments such as clarinets and saxophones wherein only a single tightening mechanism such as a screw or knob can be used for securing the reed to the mouthpiece.

It is an object of the present invention to provide a unique configuration for a reed and mouthpiece assembly for a woodwind instrument which is self-aligning and usable with woodwind instruments such as clarinets and saxophones wherein mouthpiece life is prolonged.

It is an object of the present invention to provide a unique configuration for a reed and mouthpiece assembly for a woodwind instrument which is self-aligning and usable with woodwind instruments such as clarinets and saxophones wherein misplacement of the ligature is minimized.

It is an object of the present invention to provide a unique configuration for a reed and mouthpiece assembly for a woodwind instrument which is self-aligning and usable with woodwind instruments such as clarinets and saxophones wherein accidental loosening of the ligature during playing of the instrument is minimized.

It is an object of the present invention to provide a unique configuration for a reed and mouthpiece assembly for a woodwind instrument which is self-aligning and usable with woodwind instruments such as clarinets and saxophones wherein tone quality can be adjusted as desired by various means of tightening and positioning of the reed.

It is an object of the present invention to provide a unique configuration for a reed and mouthpiece assembly for a woodwind instrument which is self-aligning and usable with-woodwind instruments such as clarinets and saxophones wherein children can have a more positive attitude relative to playing woodwind musical instruments because they are not discouraged by the difficulty often incurred in the placement of a reed correctly mounted within a ligature.

It is an object of the present invention to provide a unique configuration for a reed and mouthpiece assembly for a woodwind instrument which is self-aligning and usable with woodwind instrument such as clarinets and saxophones wherein the amount of downwardly directed pressure on the reed against the mouthpiece can be controlled to achieve greater variation in tonal quality.

It is an object of the present invention to provide a unique configuration for a reed usable with a mouthpiece assembly for a woodwind instrument such as a clarinet and/or saxophone wherein conventional ligature can be utilized if desired.

It is an object of the present invention to provide a unique configuration for a reed usable with a mouthpiece assembly for a woodwind instrument wherein any and all configurations of the protruding member can be removably mounted in the generally planar reed placement surface of the mouthpiece body to facilitate removal thereof if usage of the mouthpiece with a more conventional reed is desired for any reason.

It is an object of the present invention to provide a unique configuration for a reed usable with a mouthpiece assembly for a woodwind instrument wherein the protruding member can be a stud, plate, spine, pin or peg which is removable from the mouthpiece body for allowing selective usage thereof with a convention reed if desired.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 12:
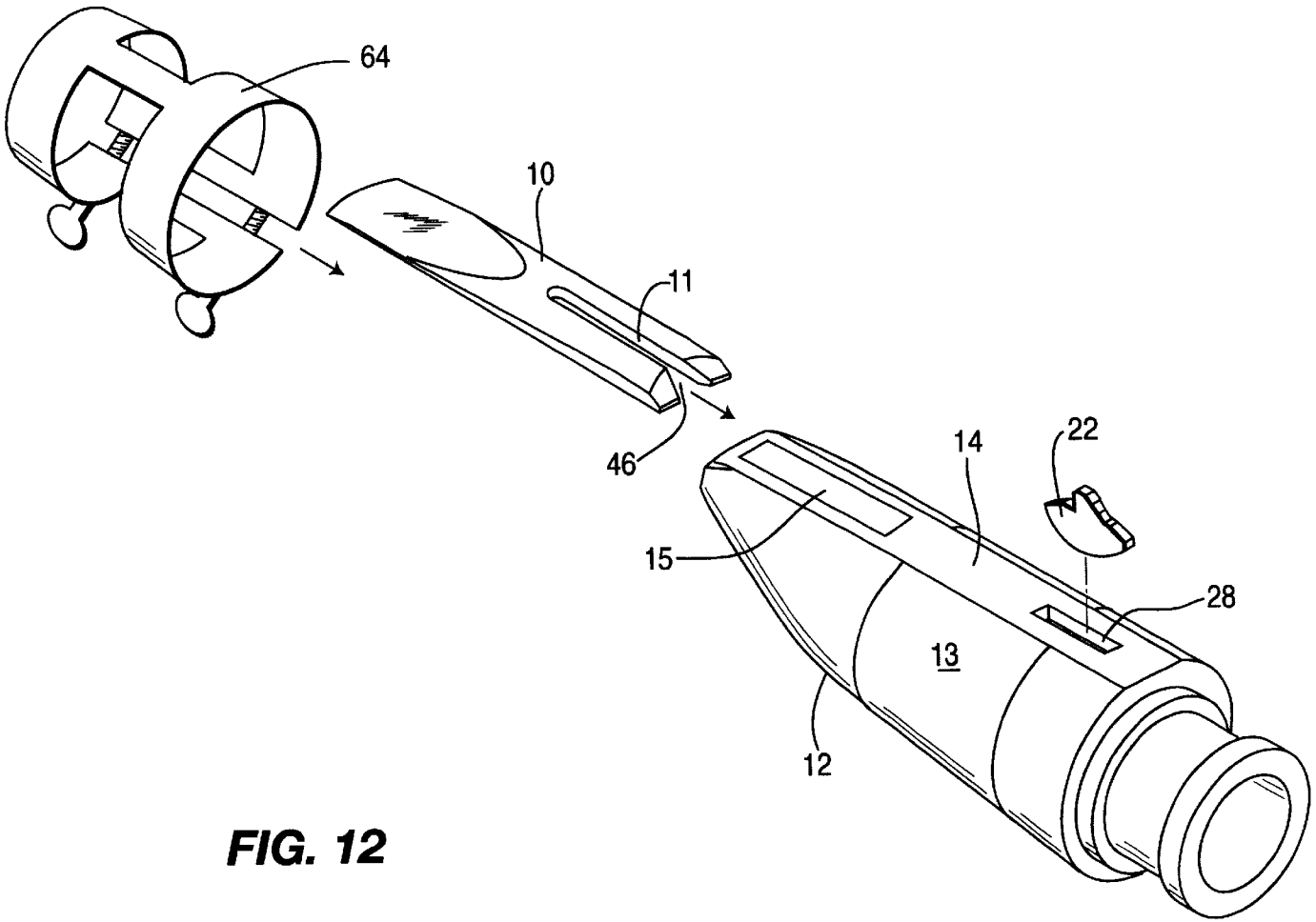
FIG. 12 is a perspective view of another alternative embodiment of the present invention showing a protruding member in the form of an alignment spine without any upwardly extending tab and illustrates usage thereof with a conventional ligature.

The present invention provides a uniquely designed configuration for a reed for use with a uniquely designed mouthpiece assembly which is self-aligning and makes replacement of a reed a quick and very easy process easily accomplished by anyone including those inexperienced or young persons who have heretofore found this activity to be difficult and time consuming. The disclosed configuration includes a reed 10 with a uniquely designed engagement means 46 adapted to engage a protruding means 44 defined extending outwardly and preferably upwardly from the generally planar reed placement surface 14 of the mouthpiece 12. This engagement means can be configured in many different ways such as a reed slot means 11 extending longitudinally therein. This reed slot 11 or engagement means 46 can be mated with the protruding means 44 extending outwardly from the mouthpiece 12 to greatly facilitate maintaining proper alignment of the reed 10 relative thereto during mounting and removal thereof and during usage thereof while retained in place by any ligature 48 which can be a unique configuration or can be a more standard ligature design such as a conventional ligature 64 as shown in FIG. 12.

Generally, the mouthpiece 12 includes a mouthpiece body 13 which defines a reed placement surface 14 thereon. The mouthpiece body 13 defines an air conduit 15 extending therethrough through which air passes when playing a woodwind instrument. Such woodwind instruments include clarinets and saxophones.

The reed placement surface 14 is preferably planar and is immediately adjacent to the air conduit 15 and is adapted to receive a reed 10 secured thereagainst. Conventional ligatures can be utilized for this purpose along with various other designs disclosed herewithin. However, the present invention does show a reed securement means 16 which is self-aligning and is a distinct improvement over these prior art configurations. The present invention, however, is usable with any ligature including the unique design disclosed herein as well as more conventional configurations such as shown in FIG. 12.

Aligning the engagement means 46 of the reed 10 and the protruding means or member 44 aids in allowing proper positioning and securement of the reed 10 relative to the reed placement surface 14 when the mouthpiece 12 and the reed 10 are clamped together with a ligature. Many different types of ligatures can be used with the present invention including the many conventional configurations such as shown in FIG. 12 as well as the more unusual means of attachment such as described herebelow and shown in FIGS. 1, 2, 6 and 7. The unique advancement of the present invention is in the engaging between the engagement means 46 of the reed 10 and the protruding means 44 extending from the reed placement surface 14.

Figure 9:
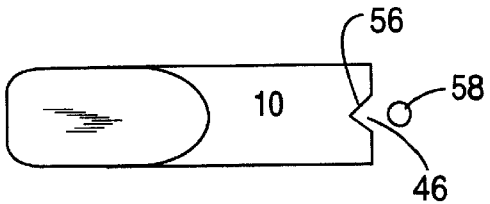
FIG. 9 is a top plan view of an alternative embodiment of the reed of the present invention showing a reed configuration with the clamped end thereof having a V-shaped notch defined therein.
Figure 8:
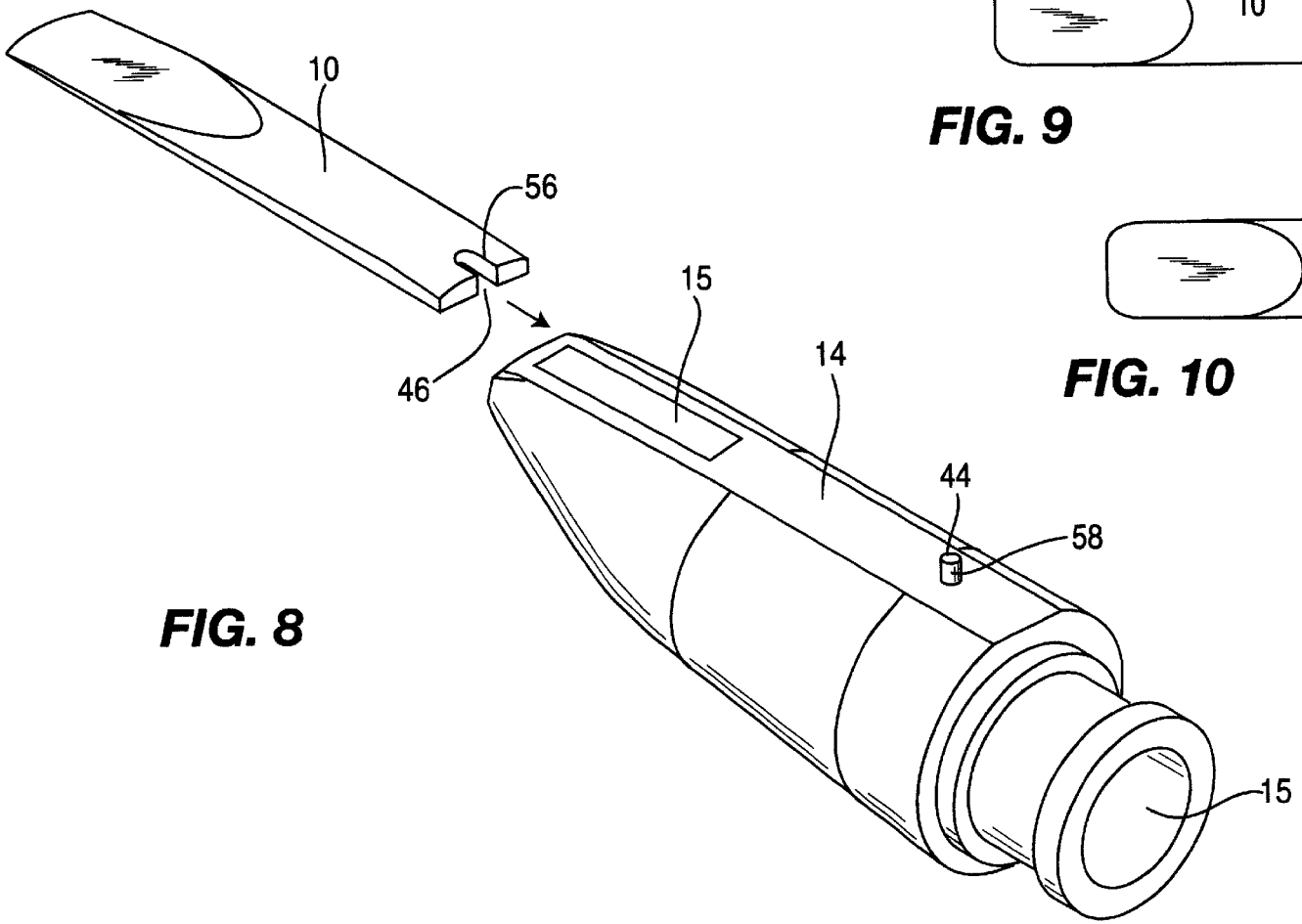
FIG. 8 is a perspective view of an embodiment of the reed and mouthpiece assembly of the present invention showing an embodiment of the reed which includes an end slot or notch and mouthpiece with alignment pin or stud extending upwardly therefrom.
Figure 11:
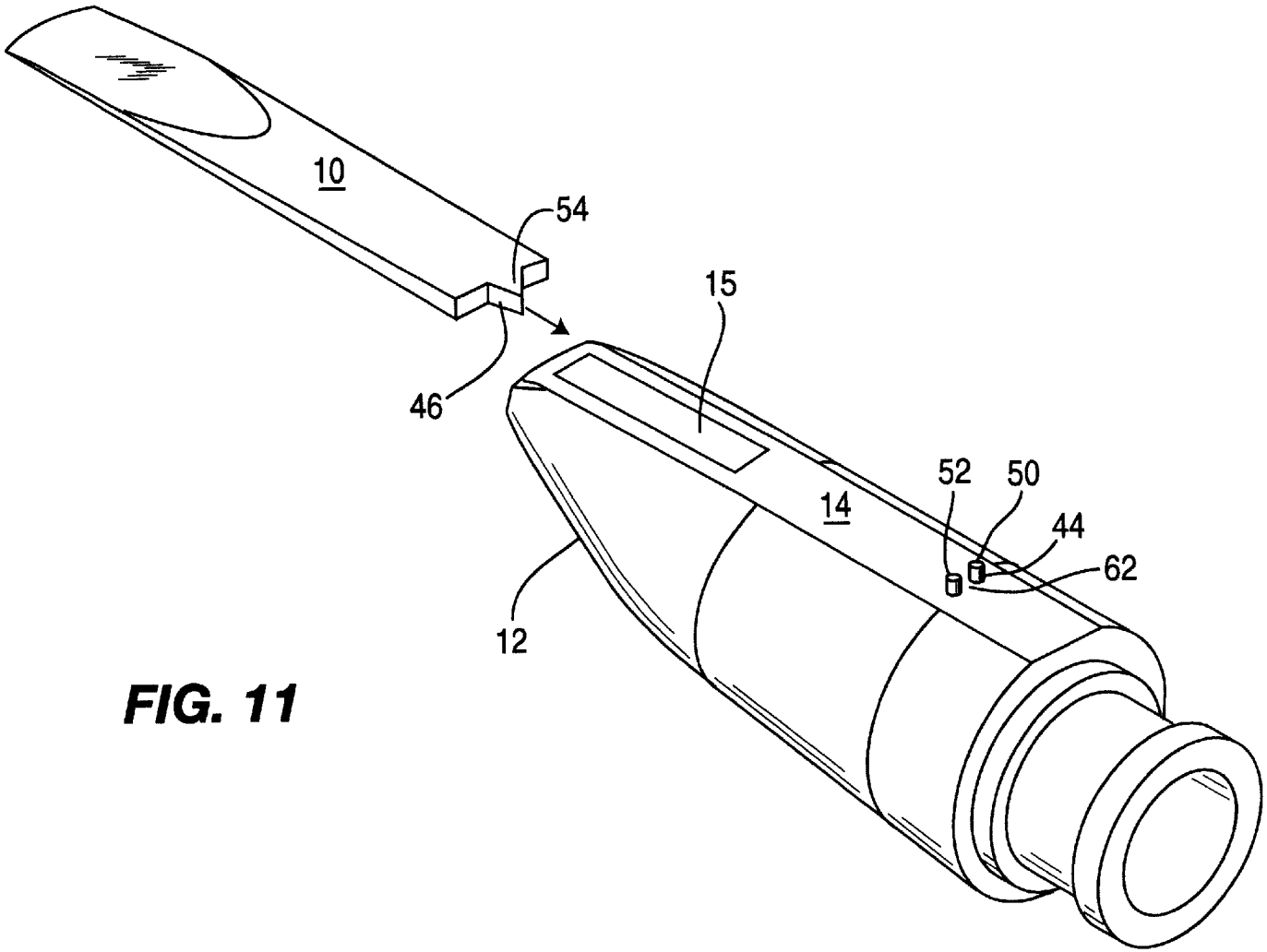
FIG. 11 is a perspective view of another alternative embodiment of the present invention showing a pointed protrusion or reed arm extending longitudinally from the reed which is adapted to be positionable between two pins extending-upwardly from the mouthpiece for facilitating selective alignment therebetween.

There are many different configurations possible for the engagement means 46 of the reed 10. For example, as shown in the Figures herein, means 46 can comprises a reed slot means 11 or a reed notch means 56, see FIGS. 8 and 9. Also engagement means 46 can comprise a reed arm means 54 extending laterally outwardly from reed 10 as shown best in FIG. 11. With this design the protruding means 44 will preferably comprises a first pin means 50 and a second pin means 52 spaced apart to define a reed arm retaining area 62 therebetween. In this configuration lateral alignment will be achieved when used with any of the many different types of ligature designs 48 currently available including conventional ligature 64 shown in FIG. 12.

Figure 10:
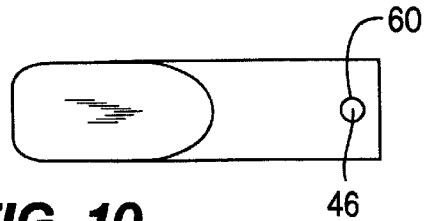
FIG. 10 is a top plan view of another alternative embodiment of the reed of the present invention showing a hole or aperture defined in the clamped end thereof for receiving a pin or stud extending upward from the mouthpiece for alignment therewith.

Similarly, there are many different possible embodiments for the configuration of the protruding means 44. Such designs can include a pin means 52 or a stud means 21 extending outwardly and upwardly from the reed placement surface and adapted to extend into the reed slot 11 or the reed aperture 60 or the reed notch 56 or any other configuration chosen for the engagement means 46. Preferred combinations include the reed notch means 56 and the peg 58 shown in FIG. 8 as well as the reed arm means 54 and the first and second pins 50 and 52 of FIG. 11. Another configuration includes the peg 58 of FIG. 8 and the reed aperture 60 shown in FIG. 10. Another design combines the peg 58 with the reed notch means 56 shown in FIG. 9. The usage of a reed slot 11 is also an important preferred configuration wherein many different designs for the protruding means 44 are usable since the slot 11 can easily receive for alignment therein, for example, the peg 58 or the stud 21 or the alignment spine 22 or other similar structure. The unique aspect of the present invention is in the use of a lateral alignment means including a protruding member 44 extending from the reed placement surface 14 in combination with a mated complementary engagement means 46 defined on the reed 10 for facilitating aligning engagement therebetween.

The reed securement means 16 can provide a self-aligning aspect which includes a tightening means 18 such as a knob 19 or the like which is engageable with respect to a thread means 42 defined on a mounting stud 21 which itself is secured to the mouthpiece body 13 at the reed placement surface 14.

In a preferred configuration mounting stud 21 is secured in the reed placement surface 14 of the mouthpiece body 13 and extends outwardly therefrom. The threaded section 42 thereof is at the outermost end of the mounting stud 21 and is engageable with the tightening knob 19. Turning of the tightening knob 19 into engagement with the threads 42 of the mounting stud 21 can be facilitated by the inclusion of a knurled exterior surface 20 on the outer area of the knob 19.

In the preferred configuration the reed 10 can be placed onto the reed placement surface 14 with the reed slot 11 extending around the mounting stud 21. Then the tightening knob 19 can be tightened manually by use of the knurled exterior surface 20 thereof downwardly such that the reed 10 is held in position on the reed placement surface 14 with the reed slot 11 extending around the mounting stud 21.

To further align the reed 11 with respect to the mouthpiece 12 and therefore also with respect to the air conduit 15 an alignment means or spine 22 may be included. This alignment means or spine is preferably positioned on the reed placement surface 14 spatially disposed longitudinally from the mounting stud 21 and is also adapted to receive the reed slot 11 extending therearound. Thus with the reed slot 11 extending around both the alignment spine 22 and the mounting stud 21 automatic self-alignment of the reed 10 with respect to the reed placement surface 14 is achieved. The reed 10 can then be secured in this position by tightening of the knob means 19.

Figure 6:
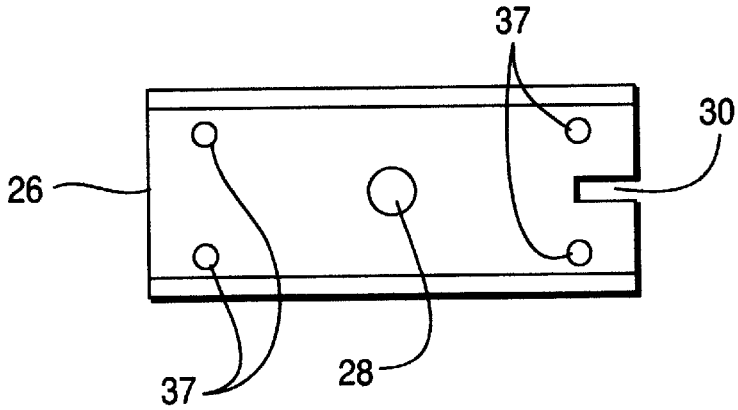
FIG. 6 is a bottom plan view of an embodiment of the pressure plate of the present invention.
Figure 7:
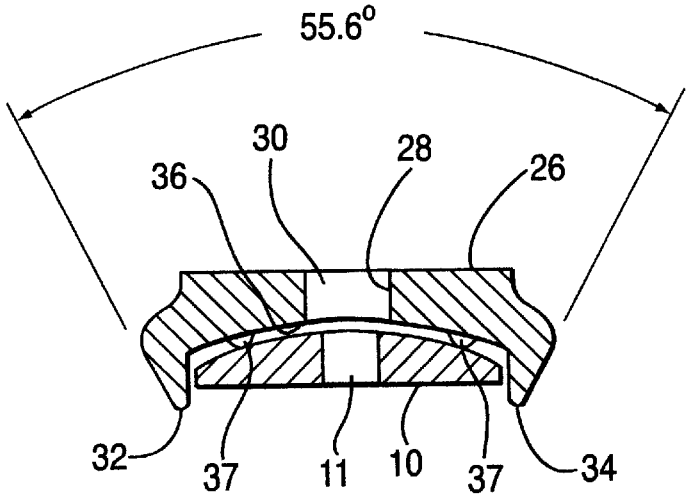
FIG. 7 is an end plan view of an embodiment of the pressure plate showing the reed retained within the reed retaining cavity.

To further facilitate alignment and securement of the reed 10 with respect to the reed placement surface 14 a pressure plate 26 can be utilized optionally. Pressure plate 26 will preferably extend longitudinally parallel with respect to the air conduit 15 within the reed placement surface 14 and will define a pressure plate hole 28 therein to allow mounting of the pressure plate upon the mounting stud 21. In this manner the reed will be placed below the pressure plate 26 and the tightening knob 19 will be positioned above the pressure plate 26 in such a manner that the pressure plate will more evenly distribute the downwardly directed forces from the tightening knob 19 as it is tightened upon the threads 42. Preferably the pressure plate 26 will include a first longitudinally extending leg member 32 and a second longitudinally extending leg member 34 at the outward lateral sides thereof to define a reed retaining cavity 36 in the under surface of plate 26. This reed retaining cavity 36 will be adapted to receive the reed 10 therein and maintain it in proper longitudinal orientation relative to the mouthpiece 12 and the air conduit 15. To further facilitate securement of the reed 10 with respect to the pressure plate 26 within the reed retaining cavity 36 thereof a plurality of pointed members or pressure plate pins 37 may be included as best shown in FIGS. 6 and 7 wherein four such members 37 are shown extending downwardly from pressure plate 26 into the reed retaining cavity 36 thereof for abutment and engagement with a reed 10 located therein. It is also important that longitudinal orientation of the pressure plate 26 be maintained and this is achieved by the defining of a pressure plate notch 30 therein. Also the alignment spine means 22 will also include an upwardly extending tab 24 defined therein. This tab 24 is adapted to extend through and engage the pressure plate notch 30 when the pressure plate 26 is in positioned mounted upon the mounting stud 21. In this manner longitudinal orientation of the pressure plate 26 is achieved by the combination of positioning of the mounting stud 21 and the alignment spine 22 in a similar manner to the engagement of those two same parts with respect to the reed slot 11 of a reed so positioned thereunder.

Figure 3:
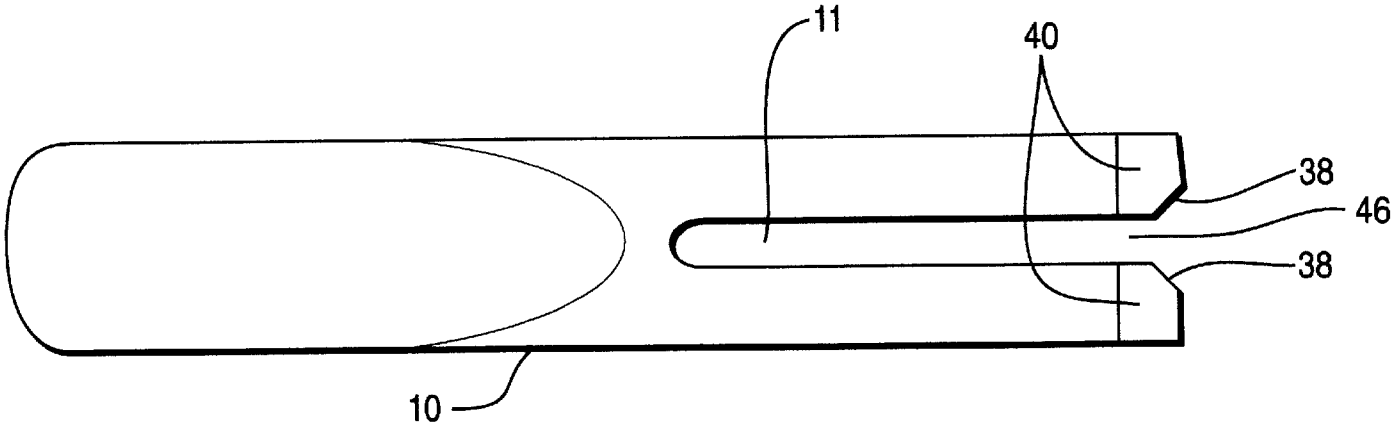
FIG. 3 is a top plan view of an embodiment of a reed for use with the present invention.
Figure 4:
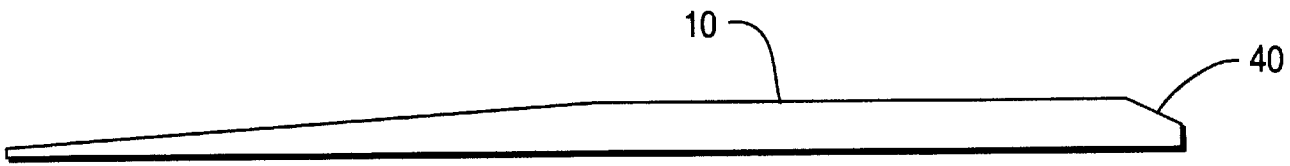
FIG. 4 is a side plan view of an embodiment of the reed shown in FIG. 3.
Figure 5:
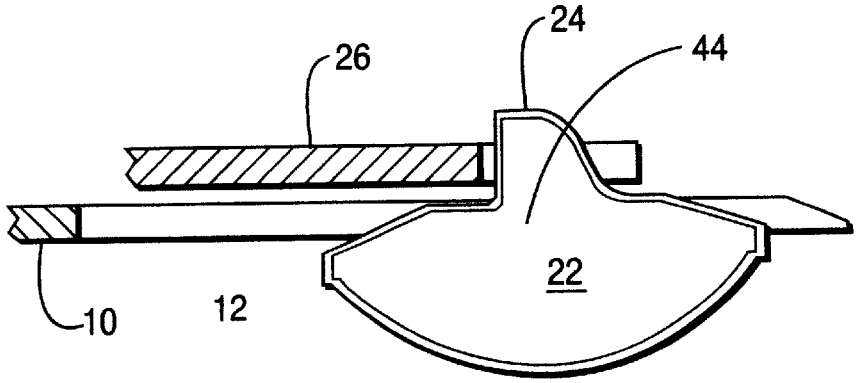
FIG. 5 is a side plan view of an embodiment of the alignment spine of the present invention shown in position in the mouthpiece with the reed and pressure plate shown in alignment with the alignment spine and tab thereof, respectively.

Ease in movement of the reed 10 into proper position on the reed placement surface 14 is further achieved by including outwardly flared areas 38 at the end of the reed slot as best shown in FIG. 3. These slightly outward flared areas at the outer extremity of the reed slot 11 will facilitate sliding movement of the reed 10 into engagement with the mounting stud 21 and will encourage engagement thereof into the reed slot 11.

Also it is preferable that the reed 10 include beveled areas in the upper portions of the reed adjacent the end of the reed slot 11. These horizontally beveled areas will facilitate movement of the reed 10 into position under the pressure plate 26 and into the reed retaining cavity 36 thereof.

Reeds used with the mouthpieces of woodwind instruments need to be replaced fairly often because they tend to wear and the tonal qualities deteriorate. Often replacement is required in the midst of a performance and speed and ease of replacement is important. This replacement activity requires manual dexterity and some skill and is very difficult especially for novice woodwind instrument players. The present invention provides a novel means for allowing extremely quick and accurate reed replacement by the use of a self-alignment feature in the reed and mouthpiece assembly of the present invention.

Figure 1:
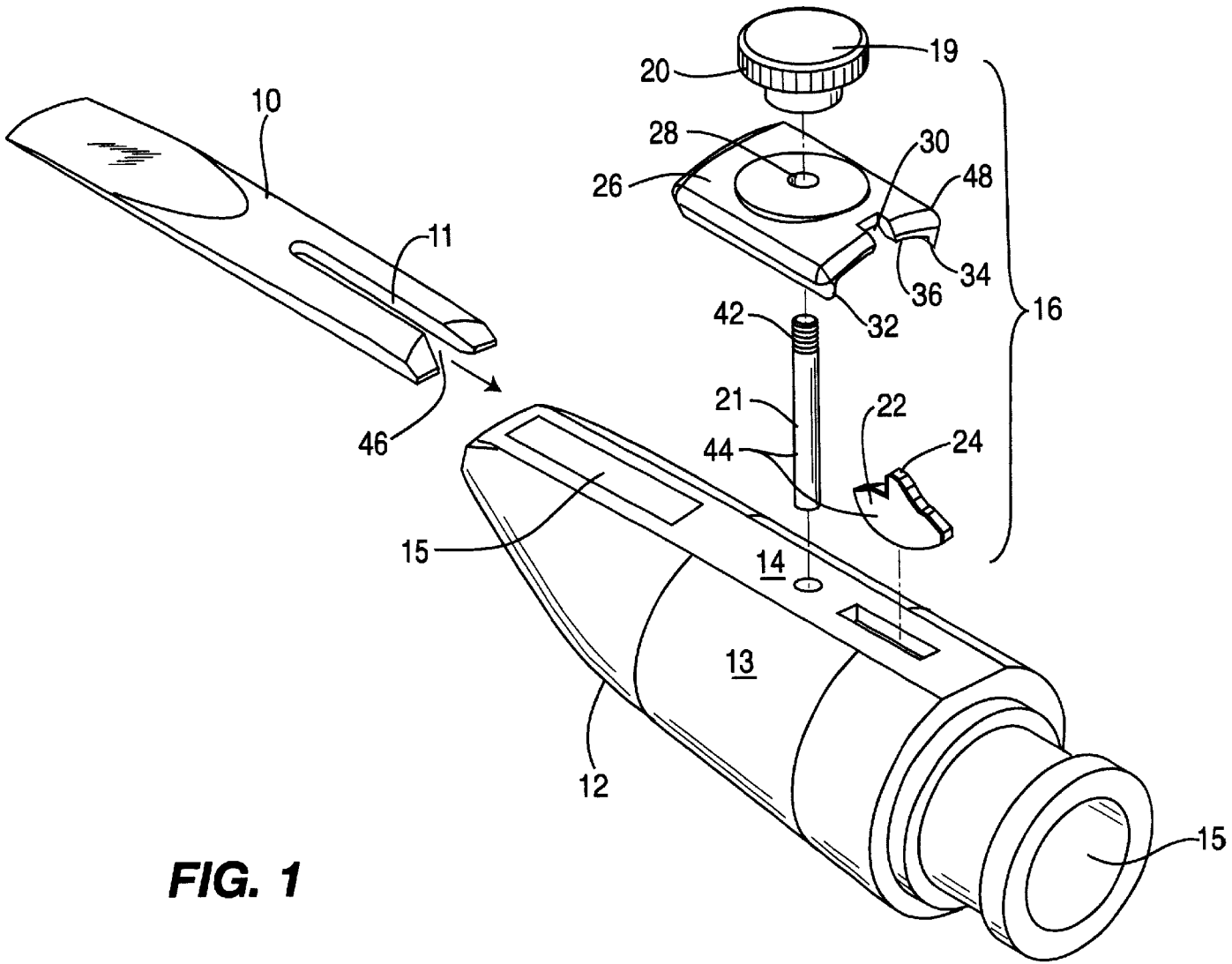
FIG. 1 is an assembly drawing in perspective showing an embodiment of the reed and mouthpiece assembly of the present invention.
Figure 2:
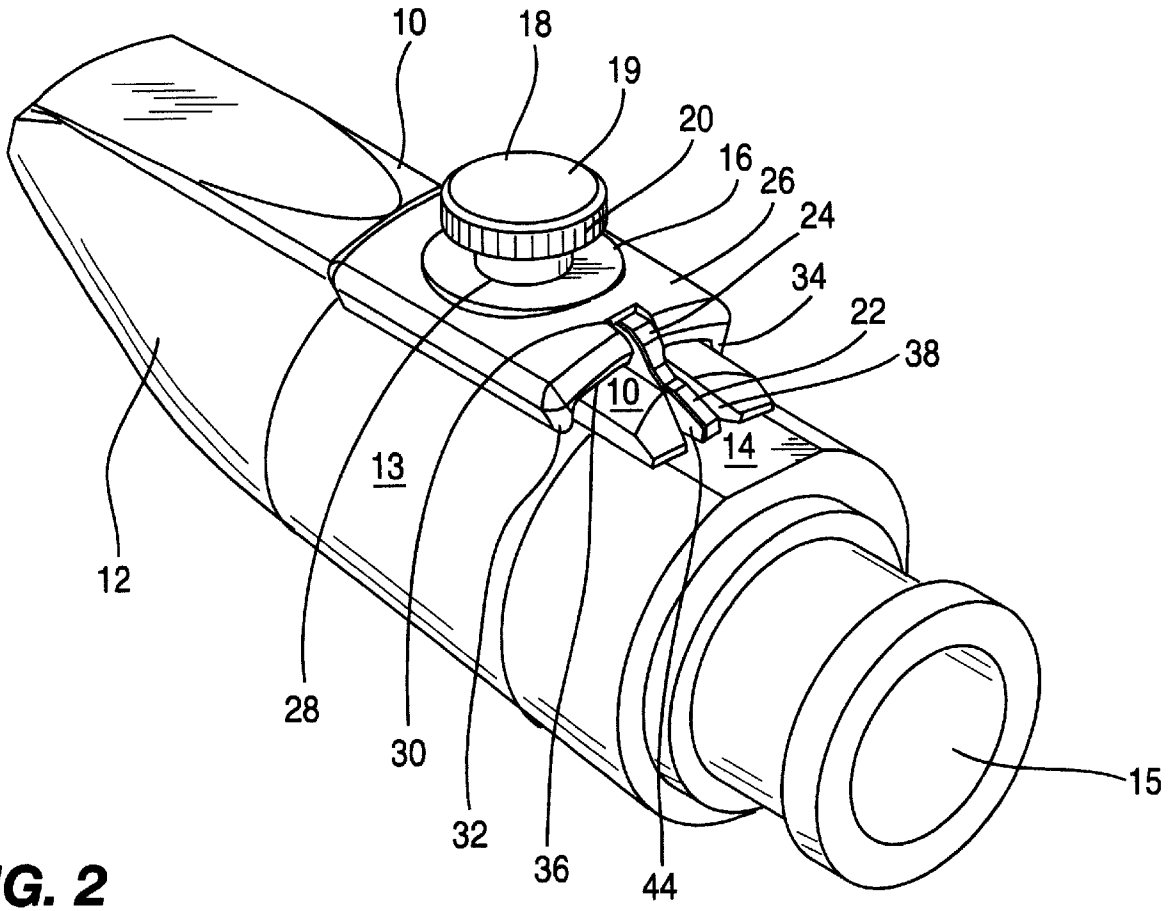
FIG. 2 is a perspective illustration of the embodiment shown in FIG. 1 shown assembled.

In use, in order to replace a reed, the user will first loosen the ligature means by rotating the tightening knob 19 by gripping of the knurled external surface 20 thereof in a counterclockwise direction for loosening. This will loosen the engagement between the pressure plate 26 and the reed 10 therebelow. The musician can then move the reed to the left as shown in FIGS. 1 and 2 such that the reed slot 11 is disengaged from its position extending around the mounting stud 21 and the pressure plate 26. Once removed a new reed can be slid along the reed placement surface 14 from the left as shown in FIGS. 1 and 2. The beveled areas 40 adjacent the reed slot 11 will ease the movement of the reed 10 into the reed retaining cavity 36 below pressure plate 26. As the end of the reed is moved to the mounting stud 21 the outwardly flared areas 38 of the reed slot 11 will facilitate movement of the reed 10 into a position with the reed slot 11 surrounding the mounting stud 21. As the reed is moved further into engagement with the reed placement surface 14 the reed slot 11 will engage the alignment spine 22. Once the reed is in full proper position the tightening knob 19 can be rotated in a clockwise direction to exert pressure downwardly on the pressure plate 26 which in turn will move the pressure plate notch 30 into engagement with respect to the tab of the alignment spine 22 and thereafter will exert downward pressure upon the reed 10 positioned within the reed retaining cavity 36 defined therebelow. Thus an extremely rapid and efficient means is provided for quick and convenient replacing of a reed for a woodwind instrument mouthpiece which is fully self-aligning.

It should be appreciated that the present invention includes a protruding member 44 which extends upwardly from the reed placement surface 14 but preferably is removably secured thereto. The configuration of the reed 10 of the present invention is a distinct improvement in the state of the art of reed design, however in certain circumstances it may be preferred to use a conventional reed if desired. In those situations, it may be necessary to render the reed placement surface 14 capable of receiving a conventionally shaped reed. To allow such usage, it is desirable to allow the protruding member 44 of the present invention to be removable from the otherwise planar reed placement surface 14 to allow use of the mouthpiece of the assembly of the present invention to be used with a conventional reed which does not include the engagement means 46 and is best usable with a completely flat mouthpiece mounting surface. This removable aspect can be optionally included with any and all of the different configurations of the protruding member 44 including the stud 21, the alignment spine or plate 22, the peg 58 or the pin means 50 and 52 as well as any other similar configurations.

FIG. 12 shows an embodiment of the present invention utilizing an alignment plate or spine 22 as the configuration of the protruding member 44. This drawing shows plate 22 capable of engaging the reed slot 11 for aligning the reed lo on the placement surface 14. This Figure also shows the use of a more conventional type of ligature 64 used in association with the unique engagement means 46 and protruding means 44 of the present invention.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A reed and mouthpiece assembly for a woodwind musical instrument comprising:

A. a mouthpiece means usable attached to a woodwind musical instrument comprising:

(1) a mouthpiece body defining an air conduit means extending therethrough for providing a supply of air to facilitate playing of a woodwind musical instrument;

(2) a reed placement surface defined on said mouthpiece body adjacent said air conduit means adapted to receive a reed detachably secured thereagainst;

(3) a protruding means extending upwardly from said reed placement surface;

B. a reed means defining an engagement means thereon being engageable with respect to said protruding means of said mouthpiece means responsive to said reed means being positioned in abutment with said reed placement surface of said mouthpiece body to facilitate alignment therebetween, said reed means adapted to be detachably securable with respect to said reed placement surface adjacent said air conduit means to control airflow therethrough for facilitating performing with the woodwind musical instrument; and C. a ligature means attachable with respect to said mouthpiece means and adapted to selectively retain said reed means in position upon said reed placement surface.

2. A reed and mouthpiece assembly for a woodwind musical instrument as defined in claim 1 wherein said reed placement surface is generally planar.

3. A reed and mouthpiece assembly for a woodwind musical instrument as defined in claim 1 wherein said engagement means comprises a reed slot means defined in said reed means engageable with respect to said protruding means.

4. A reed and mouthpiece assembly for a woodwind musical instrument as defined in claim 3 wherein said protruding means is adapted to extend into said reed slot means to facilitate engagement therebetween.

5. A reed and mouthpiece assembly for a woodwind musical instrument as defined in claim 1 wherein said engagement means comprises a reed aperture means defined in said reed means engageable with respect to said protruding means.

6. A reed and mouthpiece assembly for a woodwind musical instrument as defined in claim 5 wherein said protruding means comprises a stud means extending outwardly from said reed placement surface and adapted to extend into said reed aperture means to facilitate alignment between said reed means and said reed placement surface of said mouthpiece means responsive to being secured together by said ligature means.

7. A reed and mouthpiece assembly for a woodwind musical instrument as defined in claim 5 wherein said protruding means comprises a peg means extending outwardly from said reed placement surface and adapted to extend into said reed aperture means to facilitate alignment between said reed means and said reed placement surface of said mouthpiece means responsive to being secured together by said ligature means.

8. A reed and mouthpiece assembly for a woodwind musical instrument as defined in claim 1 wherein said engagement means comprises a reed notch means defined in said reed means engageable with respect to said protruding means.

9. A reed and mouthpiece assembly for a woodwind musical instrument as defined in claim 8 wherein said protruding means comprises a stud means extending outwardly from said reed placement surface and adapted to extend into said reed notch means to facilitate alignment between said reed means and said reed placement surface of said mouthpiece means responsive to being secured together by said ligature means.

10. A reed and mouthpiece assembly for a woodwind musical instrument as defined in claim 8 wherein said protruding means comprises a peg means extending outwardly from said reed placement surface and adapted to extend into said reed notch means to facilitate alignment between said reed means and said reed placement surface of said mouthpiece means responsive to being secured together by said ligature means.

11. A reed and mouthpiece assembly for a woodwind musical instrument as defined in claim 1 wherein said engagement means comprises a reed arm means extending outwardly laterally from said reed means to be engageable with respect to said protruding means.

12. A reed and mouthpiece assembly for a woodwind musical instrument as defined in claim 11 wherein said protruding means comprises a first pin means and a second pin means each extending upwardly from said reed placement surface and spatially disposed with respect to one another to define a reed arm retaining area therebetween to receive said reed arm means therebetween for facilitating alignment between said reed means and said reed placement surface of said mouthpiece means responsive to affixing therebetween by said ligature means.

13. A reed and mouthpiece assembly for a woodwind musical instrument as defined in claim 1 wherein said protruding means comprises a protruding member detachably securable with respect to said reed placement surface and extending outwardly therefrom to be positionable in abutment with said engagement means of said reed means for facilitating alignment therebetween.

14. A reed and mouthpiece assembly for a woodwind musical instrument as defined in claim 13 wherein said protruding member comprises an alignment spine means extending outwardly from said reed placement surface to be capable of being in mating abutment with respect to said engagement means of said reed means to facilitate alignment of reed means with respect to said reed placement surface.

15. A reed and mouthpiece assembly for a woodwind musical instrument as defined in claim 14 wherein said alignment spine means is oriented extending parallel with respect to said air conduit means defined within said mouthpiece body to facilitate alignment and positioned of said reed means with respect thereto.

16. A reed and mouthpiece assembly for a woodwind musical instrument as defined in claim 14 wherein said alignment spine means is detachable with respect to said mouthpiece means to allow usage thereof with conventionally configured reeds.

17. A reed and mouthpiece assembly for a woodwind musical instrument as defined in claim 3 wherein said reed slot means of said reed means is outwardly flared in order to facilitate alignment thereof with respect to said mounting stud means.

18. A reed and mouthpiece assembly for a woodwind musical instrument as defined in claim 3 wherein said reed means is beveled downwardly adjacent said reed slot means thereof to facilitate positioning thereof in abutment with said self-aligning securement means.

19. A reed and mouthpiece assembly for a woodwind musical instrument as defined in claim 3 wherein said protruding means comprises a stud means extending outwardly from said reed placement surface and adapted to extend into said reed slot means to facilitate alignment between said reed means and said reed placement surface of said mouthpiece means responsive to being secured together by said ligature means.

20. A reed and mouthpiece assembly for a woodwind musical instrument as defined in claim 3 wherein said protruding means comprises a peg means extending outwardly from said reed placement surface and adapted to extend into said reed slot means to facilitate alignment between said reed means and said reed placement surface of said mouthpiece means responsive to being secured together by said ligature means.

21. A reed and mouthpiece assembly for a woodwind musical instrument as defined in claim 3 wherein said protruding means comprises an alignment spine means extending outwardly from said reed placement surface to be capable of being in mating abutment with respect to said reed slot means of said reed means to facilitate alignment of reed means with respect to said reed placement surface.

22. A reed and mouthpiece assembly for a woodwind musical instrument as defined in claim 21 wherein said alignment spine means is oriented extending parallel with respect to said air conduit means defined within said mouthpiece body to facilitate alignment and positioned of said reed means with respect thereto.

23. A reed and mouthpiece assembly for a woodwind musical instrument as defined in claim 21 wherein said alignment spine means is detachable with respect to said mouthpiece means to facilitate usage thereof with conventionally configured reeds.

24. An improved reed and mouthpiece assembly for a woodwind musical instrument as defined in claim 1 wherein said protruding means defined in said mouthpiece means is detachable therefrom for selectively removing thereof to allow use of said mouthpiece means with a conventional reed if desired.

25. An improved reed for use with a mouthpiece assembly of a woodwind musical instrument having a mouthpiece body defining an air conduit extending therethrough for providing a supply of air to facilitate playing of a woodwind musical instrument and a reed placement surface defined on the mouthpiece body adjacent the air conduit to receive a reed detachably secured thereupon and a protruding member extending upwardly from the reed placement surface and a ligature attachable with respect to the mouthpiece to selectively retain the improved reed in position upon the reed placement surface, the improved reed including an engagement means thereon being engageable with respect to the protruding member of the mouthpiece responsive to said reed means being positioned in abutment with the reed placement surface of the mouthpiece body to facilitate alignment therebetween, said improved reed means being adapted to be detachably securable with respect to the reed placement surface adjacent the air conduit to control airflow therethrough.

26. A improved reed for a woodwind musical instrument as defined in claim 25 wherein said engagement means comprises a reed slot means defined in said reed means engageable with respect to the protruding member.

27. An improved reed for a woodwind musical instrument as defined in claim 26 wherein the protruding means is adapted to extend into said reed slot means to facilitate engagement therebetween.

28. An improved reed for a woodwind musical instrument as defined in claim 25 wherein said engagement means comprises a reed aperture means defined in said reed means engageable with respect to the protruding member.

29. An improved reed for a woodwind musical instrument as defined in claim 25 wherein said engagement means comprises a reed notch means defined in said reed means engageable with respect to the protruding member.

30. An improved reed for a woodwind musical instrument as defined in claim 25 wherein said engagement means comprises a reed arm means extending outwardly laterally from said reed means to be engageable with respect to the protruding member and wherein the protruding member includes a first pin and a second pin each extending upwardly from the reed placement surface and spatially disposed with respect to one another to provide a reed arm retaining area therebetween to receive said reed arm means therebetween for facilitating alignment between said reed means and the reed placement surface of the mouthpiece responsive to retaining therebetween by a ligature.

31. An improved reed for use with a mouthpiece assembly of a woodwind musical instrument as defined in claim 25 wherein the protruding member includes an alignment spine extending outwardly from the reed placement surface to be capable of being in mating abutment with respect to said engagement means of said reed means to facilitate alignment of reed means with respect to the reed placement surface.

32. An improved reed for use with a mouthpiece assembly of a woodwind musical instrument as defined in claim 25 wherein the protruding member, extending upwardly from the reed placement surface of the mouthpiece body, is detachable therefrom for selectively removing thereof to allow use of the mouthpiece body with a convention reed if desired.

* * * * *